US010826214B2

(12) United States Patent
Phillips et al.

(10) Patent No.: US 10,826,214 B2
(45) Date of Patent: Nov. 3, 2020

(54) RECEPTACLE CONNECTOR WITH ALIGNMENT FEATURES

(71) Applicant: TYCO ELECTRONICS CORPORATION, Berwyn, PA (US)

(72) Inventors: Michael John Phillips, Camp Hill, PA (US); Randall Robert Henry, Lebanon, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/572,247

(22) Filed: Sep. 16, 2019

(65) Prior Publication Data

US 2020/0014137 A1 Jan. 9, 2020

Related U.S. Application Data

(63) Continuation of application No. 15/230,853, filed on Aug. 8, 2016, now Pat. No. 10,439,311.

(51) Int. Cl.

| | |
|---|---|
| ***H01R 12/73*** | (2011.01) |
| ***H01R 12/72*** | (2011.01) |
| ***H01R 13/24*** | (2006.01) |
| ***H01R 12/70*** | (2011.01) |

(52) U.S. Cl.

CPC ..... *H01R 12/737* (2013.01); *H01R 12/7005* (2013.01); *H01R 12/721* (2013.01); *H01R 13/2442* (2013.01)

(58) Field of Classification Search

CPC ..... H01R 12/737; H01R 12/721
USPC ..... 439/637, 633, 629, 636
See application file for complete search history.

(56) References Cited

U.S. PATENT DOCUMENTS

| | | | | |
|---|---|---|---|---|
| 3,173,737 | A * | 3/1965 | Kinkaid | H01R 43/00 439/637 |
| 3,277,425 | A * | 10/1966 | Marshall | H01R 12/81 439/496 |
| 4,869,672 | A | 9/1989 | Andrews, Jr. | |
| 4,998,897 | A | 3/1991 | Rose | |
| 6,322,377 | B2 | 11/2001 | Middlehurst | |
| 6,666,705 | B1 | 12/2003 | Lauruhn et al. | |
| 6,722,915 | B1 * | 4/2004 | McAlonis | H01R 12/721 439/493 |
| 6,905,371 | B2 * | 6/2005 | Yi-Tse | H01R 24/62 174/72 R |
| 7,210,955 | B2 * | 5/2007 | Ringler | H01R 12/585 439/381 |

(Continued)

FOREIGN PATENT DOCUMENTS

CN 1328637 C 7/2007

*Primary Examiner* — Abdullah A Riyami
*Assistant Examiner* — Marcus E Harcum

(57) ABSTRACT

A receptacle connector includes a housing having a mating end for mating with a plug connector and a mounting end for mounting to a circuit board. The housing has side walls and end walls with contacts in contacts arrays along both side walls. The contacts have mating ends and terminating ends. The housing has a card slot open at the mating end for receiving plug connector defined by interior surfaces of the side walls. The mating ends of the contacts are exposed in the card slot for mating electrical connection with the plug connector. The housing has alignment tabs extending inward into the card slot from the interior surface for aligning the plug connector within the card slot.

18 Claims, 6 Drawing Sheets

(56) References Cited

U.S. PATENT DOCUMENTS

| | | | | |
|---|---|---|---|---|
| 7,234,971 | B2 | 6/2007 | Chou et al. | |
| 7,264,512 | B2 | 9/2007 | Wolford et al. | |
| 7,442,089 | B2 * | 10/2008 | Regnier | H01R 13/26 439/637 |
| 7,443,696 | B2 | 10/2008 | Lin et al. | |
| 8,231,411 | B1 | 7/2012 | Westman | |
| 8,449,335 | B2 | 5/2013 | Briant | |
| 8,579,662 | B2 | 11/2013 | Briant | |
| 8,870,600 | B2 * | 10/2014 | Wu | H01R 13/05 439/637 |
| 2005/0136739 | A1 | 6/2005 | Milbrand | |
| 2008/0214054 | A1 * | 9/2008 | Su | H01R 13/5845 439/637 |
| 2011/0021080 | A1 * | 1/2011 | Kamiya | H01R 12/721 439/637 |
| 2013/0337694 | A1 * | 12/2013 | Chen | H01R 12/721 439/637 |
| 2014/0179167 | A1 | 6/2014 | Long | |
| 2014/0235107 | A1 * | 8/2014 | Liang | H01R 12/87 439/637 |

* cited by examiner

RECEPTACLE CONNECTOR WITH ALIGNMENT FEATURES

CROSS REFERENCE TO RELATED APPLICATIONS

This application is a continuation application of U.S. patent application Ser. No. 15/230,853 filed Aug. 8, 2016, the subject matter of which is herein incorporated by reference in its entirety.

BACKGROUND OF THE INVENTION

The subject matter herein relates generally to receptacle connectors having alignment features.

High speed electrical connectors typically transmit and receive data signals across a mating interface. For example, some known receptacle connectors are mounted to a circuit board and include a card slot that receives a card edge of a plug connector at the mating interface. The receptacle connectors have contacts with deflectable spring beams at the mating interface that are spring loaded against the plug connector when the plug connector is loaded into the slot. However, known receptacle connectors are not without disadvantages. For example, the beams of the contacts may be over-deflected causing stress and/or plastic deformation, which may lead to low contact normal force on subsequent mating cycles.

A need remains for a receptacle connector that limits beam travel to reduce the risk of plastic deformation of the metal contacts.

BRIEF DESCRIPTION OF THE INVENTION

In an embodiment, a receptacle connector configured to mate with a plug connector is provided including a housing having a mating end at a top of the housing configured to mate with the plug connector and a mounting end at a bottom of the housing configured to be mounted to a circuit board. The housing has first and second side walls extending between the top and the bottom and first and second end walls extending between the top and the bottom. The housing holds a plurality of contacts in first and second contacts arrays along the first and second side walls, respectively. The contacts have mating ends configured for electrical connection with the plug connector. The contacts have terminating ends configured for electrical connection with the circuit board. The housing has a card slot open at the mating end for receiving the plug connector. The card slot is defined by interior surfaces of the first and second side walls. The mating ends of the contacts are exposed in the card slot for mating electrical connection with the plug connector. The housing has alignment tabs extending inward into the card slot from the interior surface for aligning the plug connector within the card slot.

In another embodiment, a receptacle connector configured to mate with a plug connector is provided including a housing having a mating end at a top of the housing configured to mate with the plug connector and a mounting end at a bottom of the housing configured to be mounted to a circuit board. The housing has first and second side walls extending between the top and the bottom and first and second end walls extending between the top and the bottom. The housing has contact channels holding corresponding contacts in first and second contacts arrays along the first and second side walls, respectively. The contacts having terminating ends configured for electrical connection with the circuit board and mating ends configured for electrical connection with the plug connector. The mating ends are deflectable within the contact channels when mated with the plug connector. The housing has over-travel blocks in the contact channels blocking deflection of the mating ends beyond an over-travel limit of the contacts. The housing has a card slot open at the mating end for receiving the plug connector defined by interior surfaces of the first and second side walls. The mating ends of the contacts are exposed in the card slot for mating electrical connection with the plug connector. The housing includes alignment tabs extending inward into the card slot from the interior surface for aligning the plug connector within the card slot.

In a further embodiment, a receptacle connector configured to mate with a plug connector is provided including a housing having a mating end at a top of the housing configured to mate with the plug connector and a mounting end at a bottom of the housing configured to be mounted to a circuit board. The housing has first and second side walls extending between the top and the bottom and first and second end walls extending between the top and the bottom. The housing has a card slot open at the mating end for receiving the plug connector. The housing has contact channels holding corresponding contacts in first and second contacts arrays along the first and second side walls, respectively. The contacts have terminating ends configured for electrical connection with the circuit board and mating ends configured for electrical connection with the plug connector. The mating ends are deflectable within the contact channels when mated with the plug connector. The housing includes over-travel blocks in the contact channels blocking deflection of the mating ends beyond an over-travel limit of the contact.

DETAILED DESCRIPTION OF THE INVENTION

Figure 1:
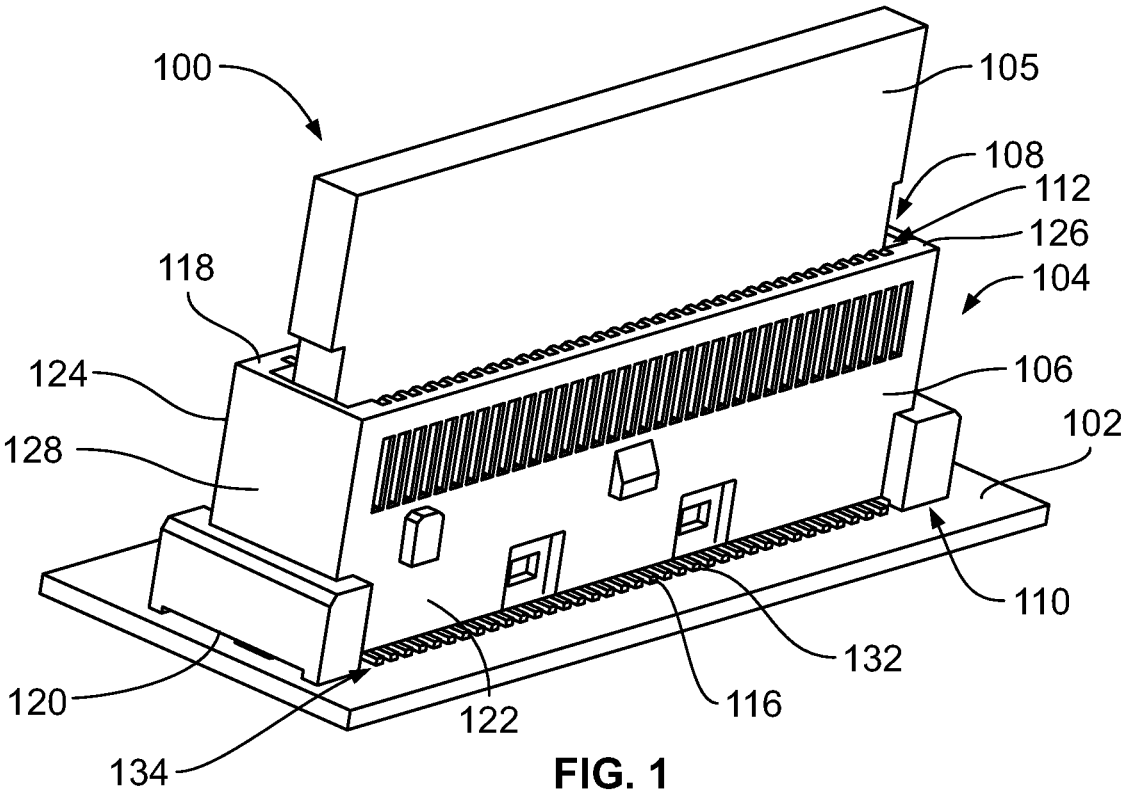
FIG. 1 is a top perspective view of an electrical connector system according to an exemplary embodiment showing a plug connector and receptacle connector in a mated state.
Figure 2:
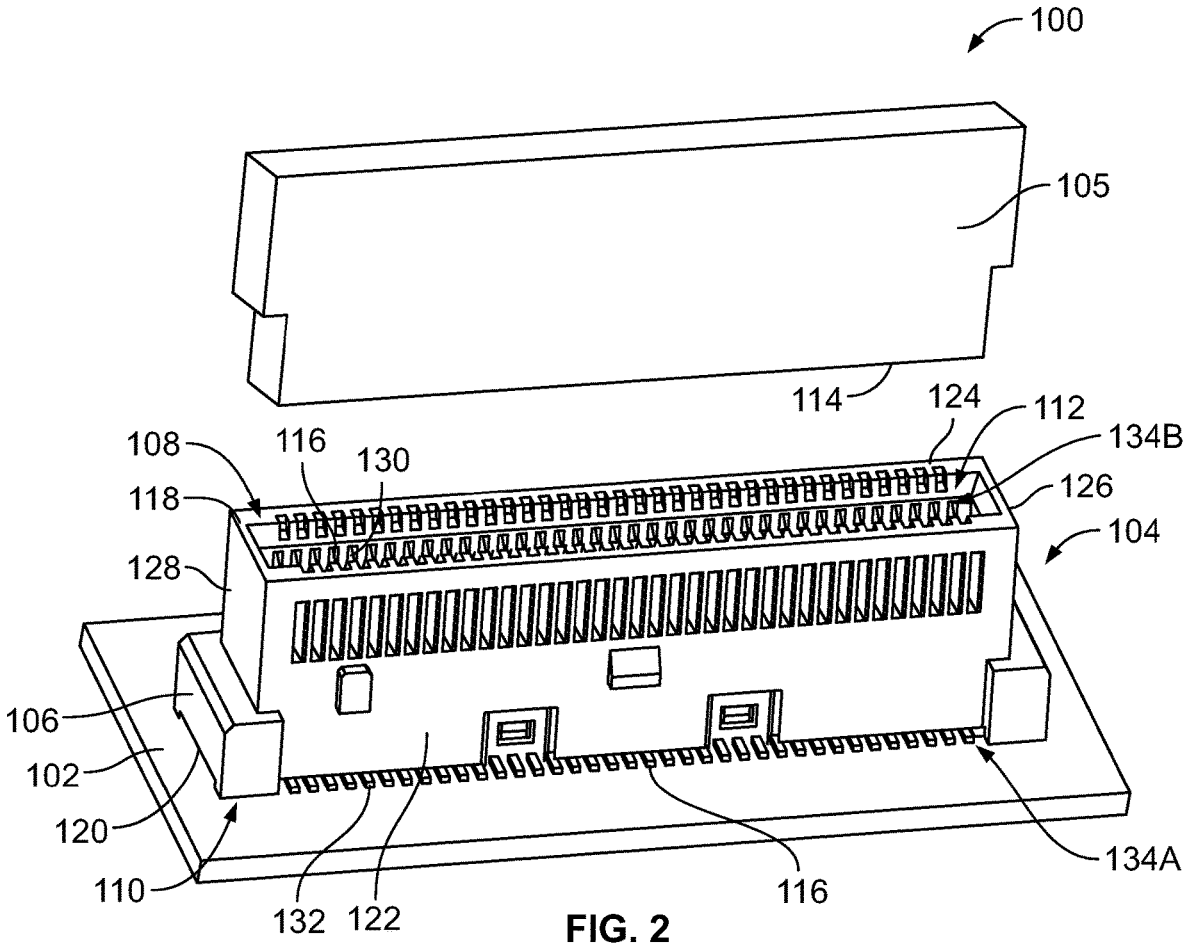
FIG. 2 is a top perspective view of the electrical connector system showing the plug connector and the receptacle connector in an unmated state.

FIG. 1 is a top perspective view of an electrical connector system 100 according to an exemplary embodiment showing components in a mated state. FIG. 2 is a top perspective view of the electrical connector system 100 showing components in an unmated state. The electrical connector system 100 includes a circuit board 102 and a receptacle connector 104 mounted to the circuit board 102 configured to electrically connect to a plug connector 105 in order to provide an electrically conductive signal path between the circuit board 102 and the plug connector 105. The receptacle connector 104 may be a high speed connector that transmits data signals at speeds over 10 gigabits per second (Gbps), such as over 25 Gbps. The receptacle connector 104 may also be configured to transmit low speed data signals and/or power. The receptacle connector optionally may be an input-output (I/O) connector.

The receptacle connector 104 includes a housing 106 extending between a mating end 108 and a mounting end 110. The mounting end 110 is terminated to a top surface of the circuit board 102. The mating end 108 defines an interface for connecting to the plug connector 105. In the illustrated embodiment, the mating end 108 defines a socket or card slot 112 that is configured to receive the plug connector 105 therein. For example, a mating end of the plug connector 105 may be defined by a card edge 114 (FIG. 2) thereof. The card edge 114 may be an edge of a circuit card of the plug connector 105 having exposed conductors on one or both sides thereof configured to be plugged into the card slot 112. In other various embodiments, the card edge 114 may be an edge of a plug housing having exposed conductors on one or both sides thereof configured to be plugged into the card slot 112 or the card edge 114 may be another pluggable structure configured to be received in the socket 112 for electrical connection with the receptacle connector 104.

Figure 1A:
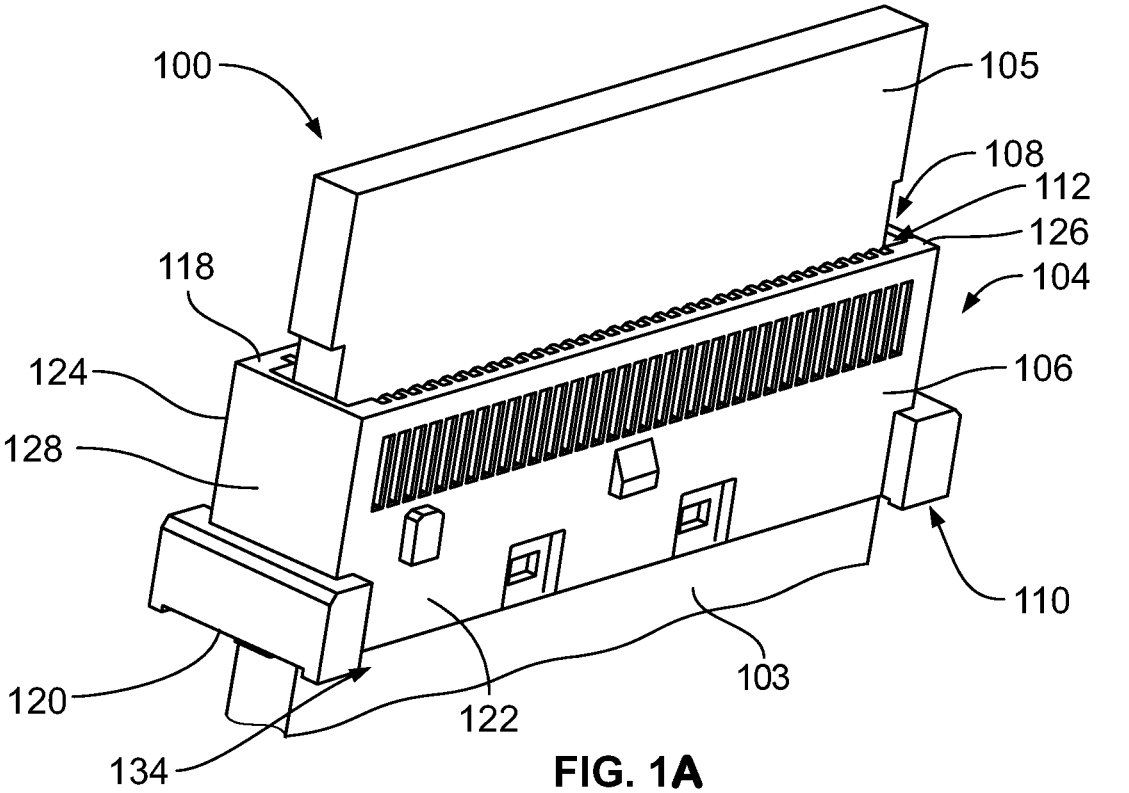
FIG. 1A is a top perspective view of an electrical connector system according to an exemplary embodiment showing the receptacle connector in accordance with an exemplary embodiment.

The receptacle connector 104, in the illustrated embodiment, is a vertical board-mount connector such that the card slot 112 is configured to receive the plug connector 105 in a loading direction that is transverse to, such as perpendicular to, the top surface of the circuit board 102. In an alternative environment, the receptacle connector 104 may be a right angle style connector that is configured to receive the plug connector 105 in a loading direction that is parallel to the top surface. In another alternative embodiment, as shown in FIG. 1A, the receptacle connector 104 may be terminated to an electrical cable 103 instead of to the circuit board 102 (as shown in FIG. 1). Optionally, the plug connector 105 may be a transceiver style connector that is configured to be terminated to one or more cables.

The housing 106 of the receptacle connector 104 holds a plurality of contacts 116 held at least partially within the housing 106. The housing 106 extends between a top 118 and an opposite bottom 120. The top 118 defines the mating end 108 of the connector 104 such that the card slot 112 extends into the connector 104 via the top 118. The bottom 120 may define at least a portion of the mounting end 110 of the connector 104. For example, the bottom 120 abuts or at least faces the top surface of the circuit board 102. The card slot 112 is defined by a first side wall 122, a second side wall 124, and first and second end walls 126, 128 that each extend between the side walls 122, 124. The side walls 122, 124 and end walls 126, 128 extend from the top 118 of the housing 106 towards the bottom 120. As used herein, relative or spatial terms such as "front," "rear," "first," "second,", "top", "bottom", "left," and "right" are only used to distinguish the referenced elements and do not necessarily require particular positions or orientations in the connector system 100 or the receptacle connector 104 relative to gravity or relative to the surrounding environment.

The contacts 116 of the receptacle connector 104 are configured to provide conductive signal paths through the receptacle connector 104. For example, each contact 116 includes a contact beam or spring beam defining a mating end 130 of the contact 116 configured to engage and electrically connect to a corresponding conductor (for example, trace or mating contact) of the plug connector 105 within the card slot 112 when the plug connector 105 is fully mated to the receptacle connector 104. The mating end 130 engages the mating conductor at a separable mating interface. The mating ends 130 are disposed within the card slot 112. The contacts 116 further include terminating ends 132 configured to be terminated to corresponding contact elements (not shown) of the circuit board 102 via thru-hole mounting to conductive vias, surface-mounting to conductive pads, and/or the like. In the illustrated embodiment, the terminating ends 132 of the contacts 116 are surface-mounted to pads on the top surface of the circuit board 102 and may be soldered to the pads on the circuit board 102.

In an embodiment, the contacts 116 are organized in at least one contact array 134. The contacts 116 in a respective array 134 are arranged side-by-side in a row. In the illustrated embodiment, the contacts 116 are organized in two arrays 134. The only portions of the contacts 116 in a first contact array 134A of the two arrays 134 that are visible in FIG. 2 are the terminating ends 132, while the only portions of the contacts 116 in a second contact array 134B of the two arrays 134 that are visible in FIG. 2 are the mating ends 132. The mating ends 130 of the contacts 116 in the first array 134A extend at least partially into the card slot 112 from the first side wall 122, and the mating ends 130 of the contacts 116 of the second array 134B extend at least partially into the card slot 112 from the second side wall 124. Thus, the mating ends 130 of the first array 134A of contacts 116 are configured to engage one side of the card edge 114 of the plug connector 105, while the mating ends 130 of the second array 134B of contacts 116 are configured to engage the opposite side of the card edge 114. The mating ends 130 may be configured to deflect towards and/or into the respective side walls 122, 124 from which the mating ends 130 extend in order to exert a biased retention force on the plug connector 105 to retain mechanical and electrical contact with the corresponding mating conductors. The card edge 114 of the plug connector 105 may be generally centered within the card slot 112 to balance the mating forces of the contacts 116. In an exemplary embodiment, the housing 106 includes alignment features to ensure that the plug connector 105 is generally centered within the card slot 112, which may reduce over-travel, and thus damage, to the contacts 116.

Figure 3:
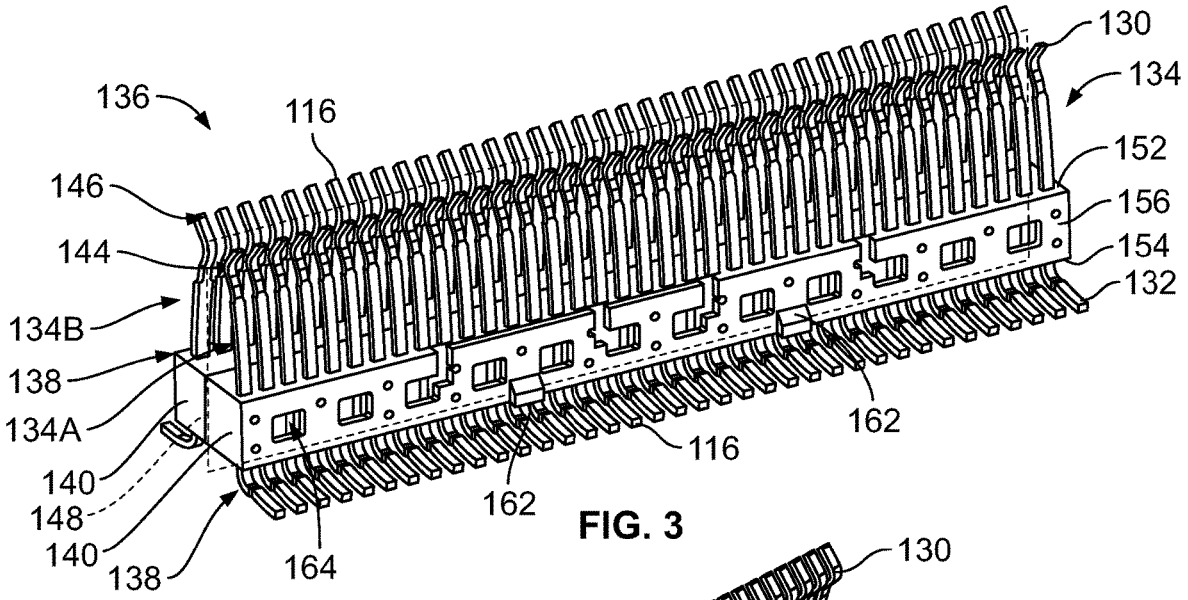
FIG. 3 is a perspective view of a contact assembly for the receptacle connector according to an exemplary embodiment.
Figure 4:
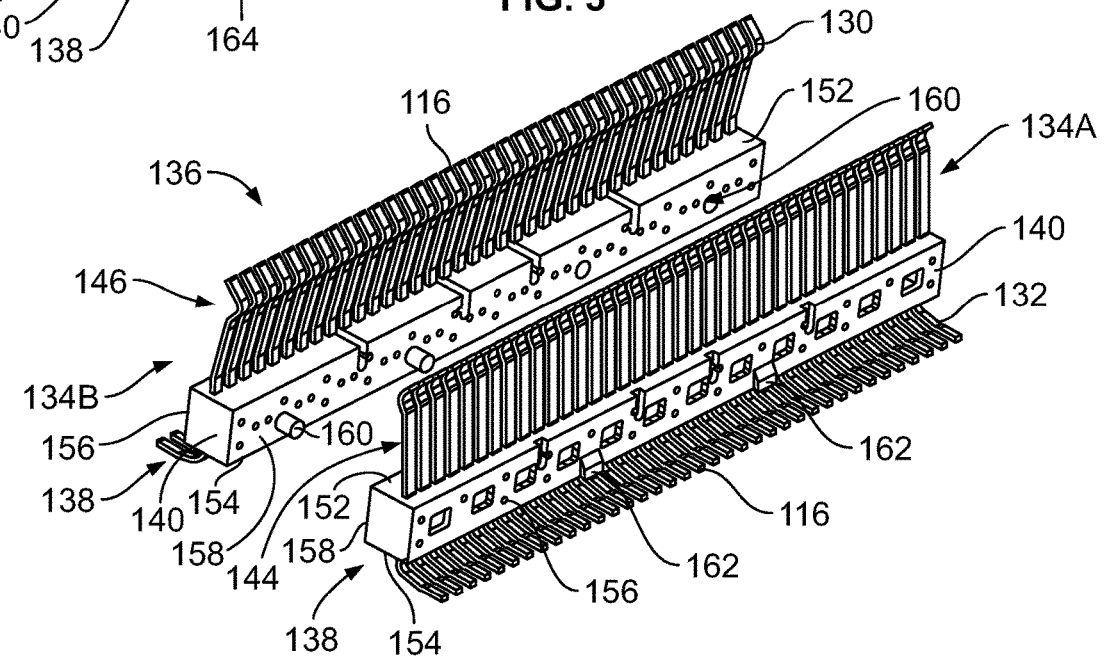
FIG. 4 is a perspective view of the contact assembly in an unassembled state.
Figure 5:
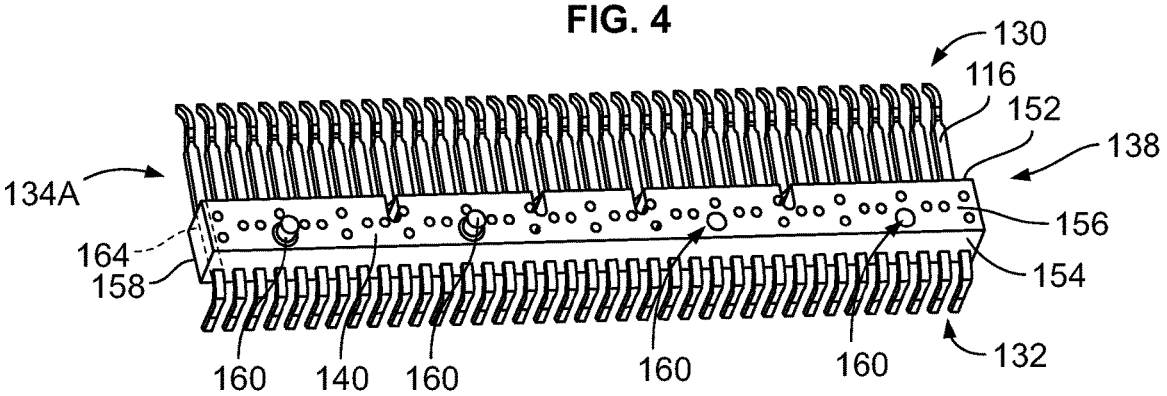
FIG. 5 is a perspective view of a portion of the contact assembly.

FIG. 3 is a perspective view of a contact assembly 136 for the receptacle connector 104 (shown in FIG. 1) according to an exemplary embodiment. FIG. 4 is a perspective view of the contact assembly 136 in an unassembled state. FIG. 5 is a perspective view of a portion of the contact assembly 136. In the illustrated embodiment, the contact assembly 136 includes two contact sub-assemblies 138 (FIG. 5 illustrates one of the contact sub-assemblies 138), configured to be coupled together to form the contact assembly 136. Each contact sub-assembly 138 includes a dielectric carrier 140 holding a plurality of the contacts 116. Optionally, as in the illustrated embodiment, the contact sub-assemblies 138 may be identical components inverted 180° and coupled together. In other embodiments, the contact sub-assemblies 138 may be similar to each other, but not identical, having some different features, such as securing features for securing the components together and/or to the housing 106 (shown in FIG. 1). Optionally, the contact sub-assemblies 138 may be hermaphroditic having hermaphroditic securing features (for example, posts and openings).

The contacts 116 are distributed in the arrays 134A, 134B. For example, the first array 134A is provided in one contact sub-assembly 138 and the second array 134B is provided in the other contact sub-assembly 138. The mating ends 130 of the contacts 116 in the first array 134A are arranged side-by-side in a first row 144 (FIG. 3), and the mating ends 130 of the contacts 116 in the second array 134B are arranged side-by-side in a second row 146 (FIG. 3). The first and second rows 144, 146 extend parallel to each other on opposite sides of a central plane 148 of the contact assembly 136 (the central plane 148 is shown oriented vertically and extending longitudinally through the contact assembly 136).

Each contact 116 extends continuously between the terminating end 132 and the mating end 130. Adjacent contacts 116 in the same array 134 may extend parallel to one another. The contacts 116 are composed of an electrically conductive material, such as one or more metals. The contacts 116 may be stamped and formed into shape from a flat sheet of metal. In an embodiment, at least some of the contacts 116 of the receptacle connector 104 are used to convey high speed data signals and some other contacts 116 are used as ground conductors to provide electrical shielding for the high speed signals and ground paths through the receptacle connector 104. Some of the contacts 116 may be used to provide low speed data signals, power, or the like, instead of high speed data signals.

The contacts 116 in each array 134 are evenly spaced-apart along the longitudinal axis of the contact assembly 136. In an embodiment, the contacts 116 are held in place by the dielectric carrier 140. The dielectric carrier 140 extends between a top 152 and a bottom 154. The dielectric carrier 140 has a front 156 and a rear 158 between the top 152 and the bottom 154. The rears 158 of the dielectric carriers 140 face and may abut against each other when the contact assembly 136 is assembled. The rear 158 of each dielectric carrier 140 may include one or more securing features 160 for securing the dielectric carriers 140 together when the contact assembly 136 is assembled. The securing features 160 may interact with each other to secure the contact sub-assemblies 138 together. For example, the securing features 160 may be any combination of posts, openings, latches, catches, clips, fasteners or other types of securing features. In other alternative embodiments, rather than having two dielectric carriers 140, the contact assembly 136 may include a single dielectric carrier 140 holding either both arrays 134 or a single array 134. The fronts 156 of the dielectric carriers 140 may face in opposite directions and may engage the housing 106. The front 156 of either or both dielectric carriers 140 may include one or more securing features 162 for securing the contact assembly 136 to the housing 106. The securing features 162 may interact with corresponding securing features of the housing 106 to secure the contact assembly 136 to the housing 106. For example, the securing features 162 may be any combination of clips, latches, catches, protrusions, openings or other types of securing features.

The contacts 116 extend through the dielectric carrier 140 such that the mating ends 130 protrude from the top 152 and terminating ends 132 protrude from the bottom 154 with the dielectric carrier 140 engaging and holding an intermediate section 164 of the contacts 116 to retain the relative positioning and orientations of the contacts 116. The dielectric carrier 140 is formed of a dielectric material, such as a plastic or one or more other polymers. Optionally, the dielectric carrier 140 may be overmolded around the contacts 116. Alternatively, the contacts 116 may be loaded or stitched into the dielectric carrier 140.

Figure 6:
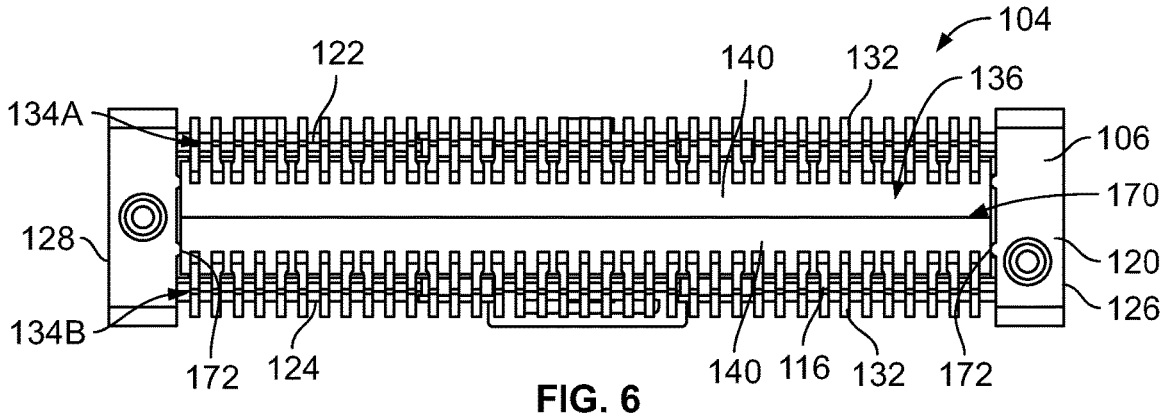
FIG. 6 is a bottom view of the receptacle connector in accordance with an exemplary embodiment.

FIG. 6 is a bottom view of the receptacle connector 104 in accordance with an exemplary embodiment. The housing 106 includes a contact assembly cavity 170 at the bottom 120 that receives the contact assembly 136. The contact assembly 136 is loaded into the contact assembly cavity 170 until the terminating ends 132 of the contacts 116 are at the bottom 120. The terminating ends 132 of the first and second contact arrays 134A, 134B extend away from each other in opposite directions. Optionally, the terminating ends 132 may be positioned below the side walls 122, 124. The housing 106 includes end wall positioning ribs 172 on the end walls 126, 128. The end wall positioning ribs 172 position and/or center the contact assembly 136 within the contact assembly cavity 170. Optionally, the end wall positioning ribs 172 may be crush ribs configured to deform or crush when the contact assembly 136 is loaded into the contact assembly cavity 170. The contact assembly 136 may be held in the contact assembly cavity 170 by an interference fit between the end wall positioning ribs 172. In the illustrated embodiment, the end wall positioning ribs 172 engage the dielectric carriers 140.

Figure 7:
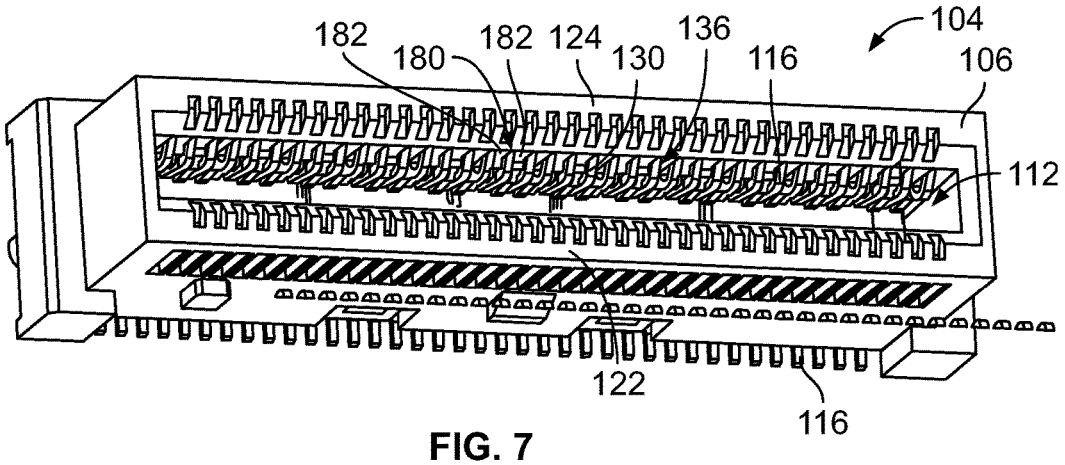
FIG. 7 is a top perspective view of the receptacle connector in accordance with an exemplary embodiment.

FIG. 7 is a top perspective view of the receptacle connector 104 in accordance with an exemplary embodiment. When assembled, the contact assembly 136 is received in the housing 106 such that the mating ends 130 of the contacts 116 are exposed within the card slot 112. In an exemplary embodiment, the housing 136 includes a plurality of contact channels 180 in the first and second side walls 122, 124. Each contact channel 180 receives a corresponding contact 116. The housing 106 includes separating walls 182 between the contact channels 180. The separating walls 182 hold the relative positions of the contacts 116. The separating walls 182 hold the contacts 116 in the contact channels 180. The separating walls 182 hold the contacts 116 parallel to each other and/or parallel to the mating direction with the plug connector 105 (shown in FIG. 1).

In an exemplary embodiment, the mating ends 130 are deflectable into the contact channels 180 when the plug connector 105 is loaded into the card slot 112. When the mating ends 130 are deflected, the contacts 116 are spring loaded against the plug connector 105 due to an internal biasing force exerted by the spring beams of the contacts 116. Spring loading the contacts 116 creates a mechanical and electrical connection with the plug connector 105.

In an exemplary embodiment, the housing 106 includes features that center the plug connector 105 within the card slot 112 to prevent over-travel of any of the contacts 116 caused when the mating ends 130 are deflected beyond an elastic limit. Centering the plug connector 105 also balances the opposing spring forces of the two rows of contacts 116.

Figure 8:
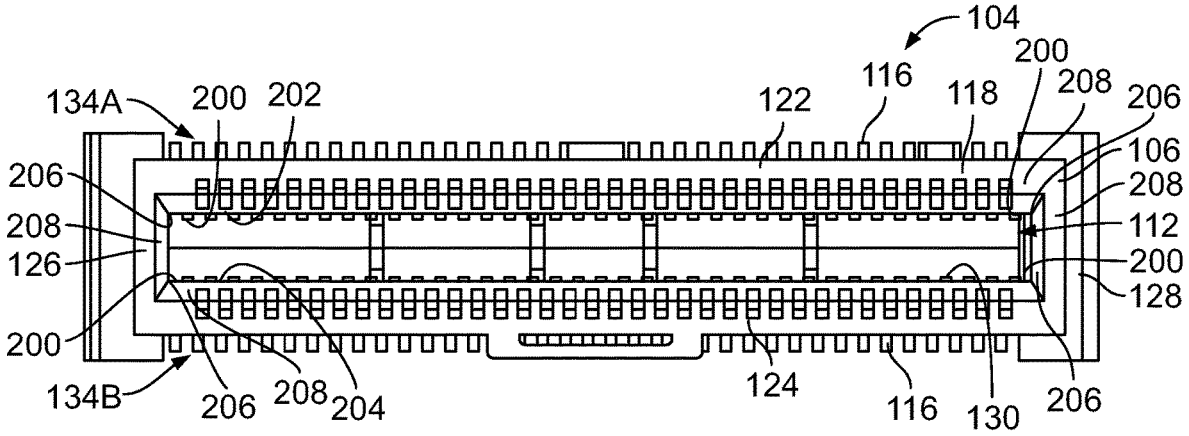
FIG. 8 is a top view of the receptacle connector in accordance with an exemplary embodiment.

FIG. 8 is a top view of the receptacle connector 104 in accordance with an exemplary embodiment. In an exemplary embodiment, the housing 106 includes alignment tabs 200 extending into the card slot 112 for aligning the plug connector 105 (shown in FIG. 1) within the card slot 112. The alignment tabs 200 may be used to center the plug connector 105 within the card slot 112.

The card slot 112 is defined by interior surfaces 202, 204 of the first and second side walls 122, 124, respectively. The interior surfaces 202, 204 oppose each other on opposite sides of the card slot 112. In an exemplary embodiment, the mating ends 130 of the contacts 116 extend beyond the interior surfaces 202, 204 into the card slot 112 such that the mating ends 130 may interface with the plug connector 105 when plugged into the card slot 112.

The alignment tabs 200 extend into the card slot 112 from the interior surfaces 202, 204 for positioning the plug connector 105 within the card slot 112. As such, the width of the card slot 112 between the alignment tabs 200 is less than the width of the card slot 112 along other portions of the card slot 112. In an exemplary embodiment, the housing 106 includes alignment tabs 200 at each corner 206 of the card slot 112 defined by the intersections between the side walls 122, 124 and the end walls 126, 128. Optionally, the alignment tabs 200 may be provided at the ends walls 126, 128. For example, the alignment tabs 200 may be positioned outward of the contact arrays 134A, 134B, such as between the contacts 116 and the end walls 126, 128. The alignment tabs 200 may be provided at other locations in alternative embodiments.

In an exemplary embodiment, the housing 106 includes chamfered surfaces 208 at the top 118 that provide a lead-in for the plug connector 105 into the card slot 112. The chamfered surfaces 208 may be provided on the side walls 122, 124 and/or the end walls 126, 128. The chamfered surfaces 208 guide the plug connector 105 into the card slot 112. In an exemplary embodiment, the chamfered surfaces 208 extend to the alignment tabs 200. For example, the chamfered surfaces 208 may extend onto top ends of the alignment tabs 200, such that the top ends of the alignment tabs 200 are chamfered.

Figure 9:
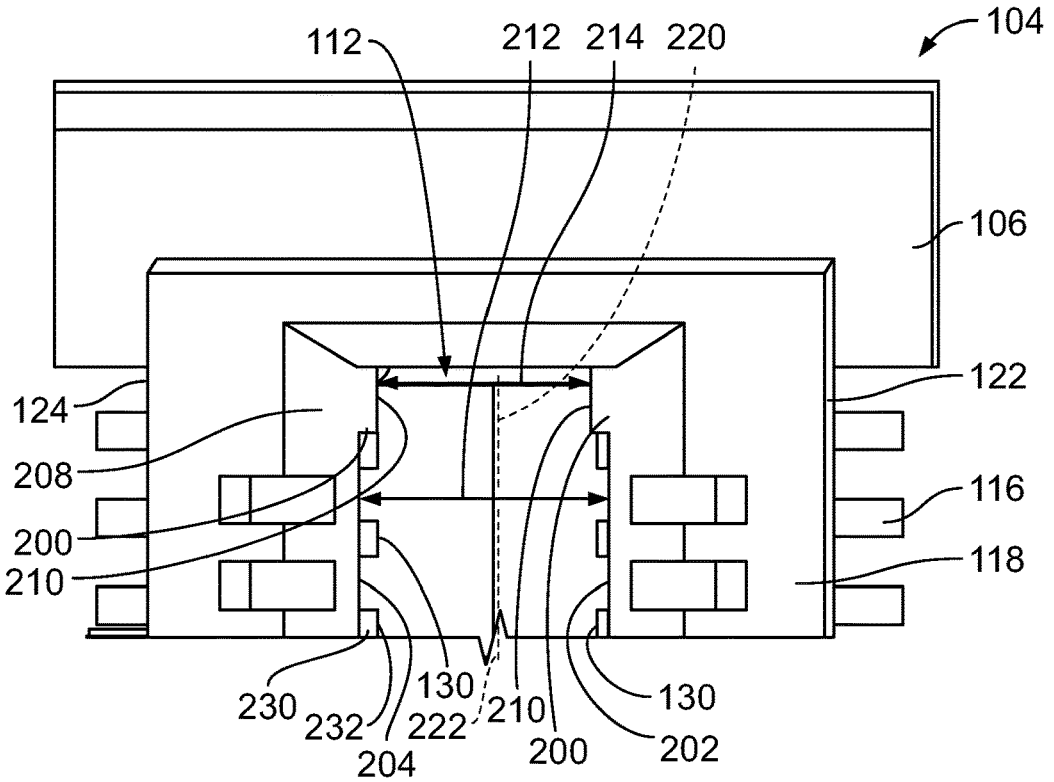
FIG. 9 is an enlarged view of one of the ends of the receptacle connector showing alignment tabs.
Figure 10:
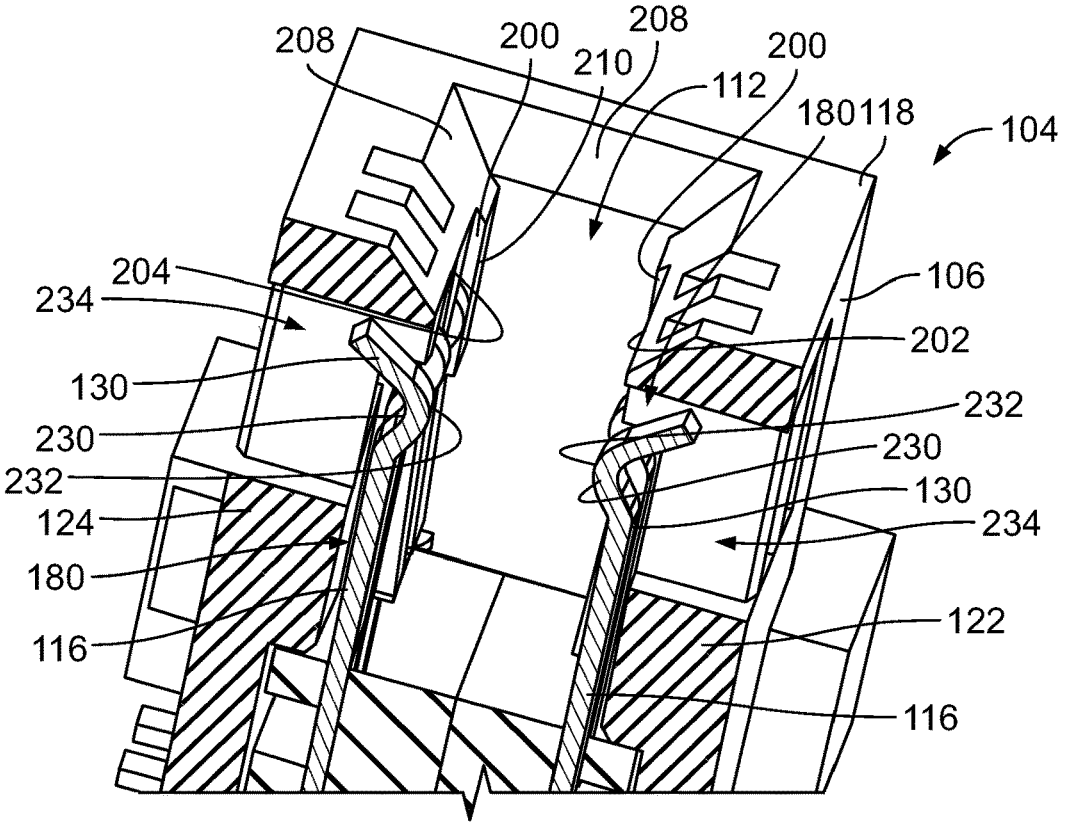
FIG. 10 is a sectional view of a portion of the receptacle connector showing the alignment tabs at one of the ends of the receptacle connector.

FIG. 9 is an enlarged view of one of the ends of the receptacle connector 104 showing the alignment tabs 200. FIG. 10 is a sectional view of a portion of the receptacle connector 104 showing the alignment tabs 200 at one of the ends of the receptacle connector 104. Optionally, the alignment tabs 200 may extend the entire height of the card slot 112. Alternatively, as in the illustrated embodiment, the alignment tabs 200 may be provided at or near the top 118, such as directly below the chamfered surfaces 208 at the top 118. The alignment tabs 200 are integral with the first and second side walls 122, 124. For example, the alignment tabs 200 are co-molded with the housing 106 when the housing 106 is manufactured.

The alignment tabs 200 include alignment surfaces 210 facing the card slot 112. The alignment surfaces 210 are positioned interior of the interior surfaces 202, 204 of the first and second side walls 122, 124. For example, the alignment tabs 200 extend beyond the interior surfaces 202, 204 into the card slot 112. The alignment tabs 200 are used to hold the plug connector 105 (FIG. 1) spaced-apart from the interior surfaces 202, 204. For example, gaps or spaces, which may be approximately as wide as the alignment tabs 200, may be defined between the plug connector 105 and the interior surfaces 202, 204. The card slot 112 has a first width 212 between the interior surfaces 202, 204 of the first and second side walls 122, 124. The card slot 112 has a second width 214 between the alignment surfaces 210 of the alignment tabs 200 that is narrower than the first width 212.

In an exemplary embodiment, both alignment tabs 200 extend the same distance from the corresponding side walls 122, 124 such that the plug connector 105 may be centered between the side walls 122, 124. For example, the alignment tabs 200 have a tab center line 220 centered between the alignment surfaces 210 of the alignment tabs 200. The tab center line 220 is aligned with a card slot center line 222 of the card slot 112 centered between the interior surfaces 202, 204 of the first and second side walls 122, 124. Because the tab center line 220 is aligned with the card slot center line 222, the alignment tabs 200 serve to center the plug connector 105 between the mating ends 130 of the contacts 116.

As shown in FIG. 10, the contacts 116 include interface bumps 230 at the mating ends 130 configured to interface with the plug connector 105. The interface bumps 230 are convex shaped bends in the contacts 116 at the mating ends 130. The interface bumps 230 extend beyond the interior surfaces 202, 204 into the card slot 112 to interface with the plug connector 105 (FIG. 1). The interface bumps 230 define mating interfaces 232 configured to engage the plug connector 105. The mating interfaces 232 may be approximately coplanar with the alignment surfaces 210 of the alignment tabs 200; however, the mating interfaces 232 may extend slightly beyond the alignment surfaces 210 into the card slot 112 to ensure contact with the plug connector 105. Distal ends of the contacts 116 (for example, above the mating interfaces 232) are bent back into the contact channels 180 to prevent stubbing with the plug connector 105 when the plug connector 105 is loaded in the card slot 112.

The mating ends 130 may be deflected outward, such as into the contact channels 180, when the plug connector 105 is loaded into the card slot 112. For example, relief slots 234 are provided in the side walls 122, 124 to receive the contacts 116 when the contacts 116 are deflected outward.

The alignment tabs 200 serve to center the plug connector 105 within the card slot 112 such that the plug connector 105 does not overstress the spring beams of the contacts 116. For example, the alignment tabs 200 restrict the plug connector 105 from being loaded too close to the first side wall 122 or too close to the second side wall 124, which may overstress the corresponding contacts 116. By centering the plug connector 105 in the card slot 112, neither row of contacts 116 is overstressed.

Figure 11:
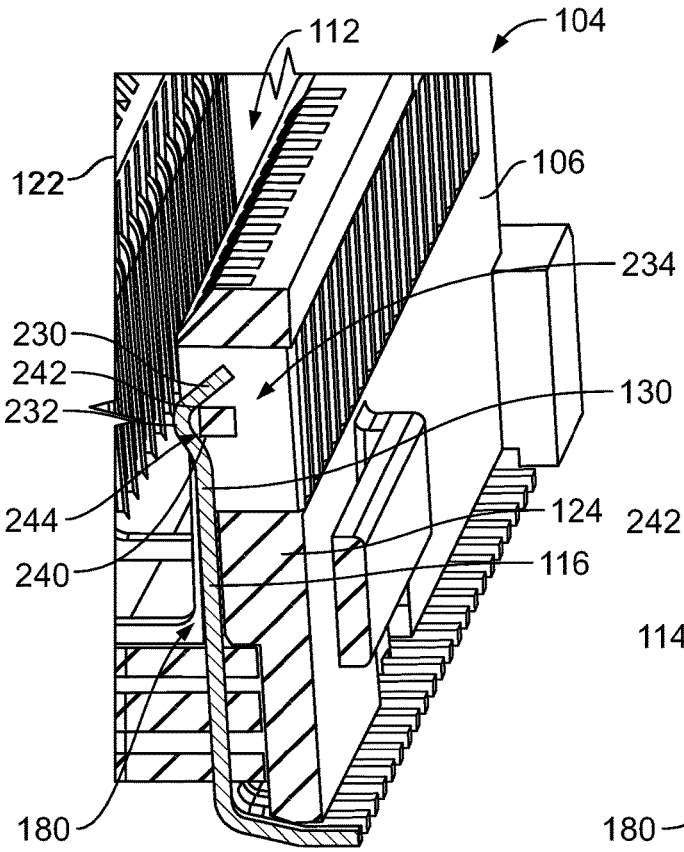
FIG. 11 is a partial-sectional view of a portion of the receptacle connector.
Figure 12:
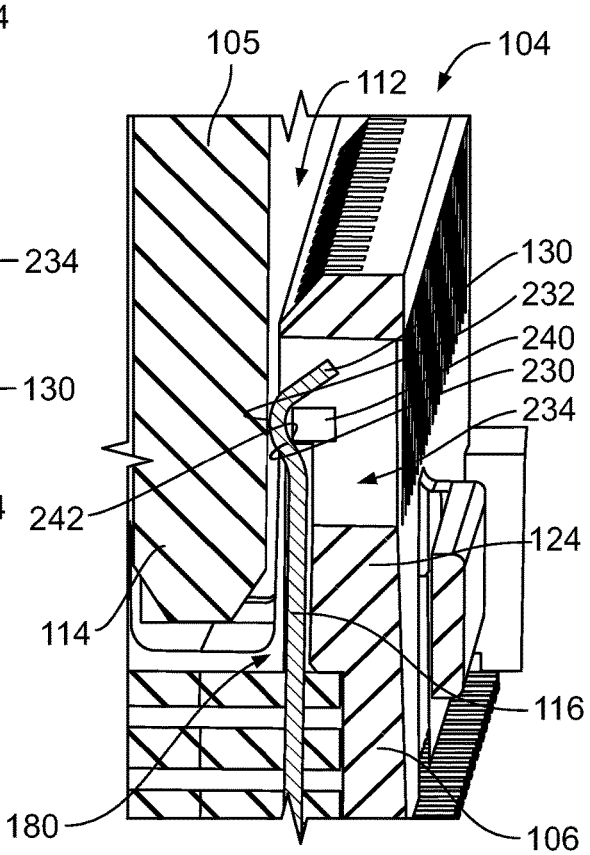
FIG. 12 is a partial-sectional view of a portion of the receptacle connector showing the plug connector in a card slot of the receptacle connector.
Figure 13:
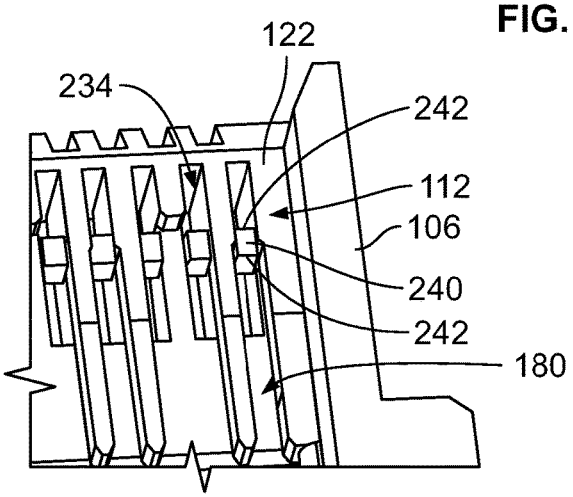
FIG. 13 is a partial-sectional view of a portion of the receptacle connector.

FIG. 11 is a partial-sectional view of a portion of the receptacle connector 104. FIG. 12 is a partial-sectional view of a portion of the receptacle connector 104 showing the plug connector 105 in the card slot 112. FIG. 13 is a partial-sectional view of a portion of the receptacle connector 104 showing the housing 106.

In an exemplary embodiment, the housing 106 includes over-travel blocks 240 to block deflection of the mating ends 130 of the contacts 116 beyond an over-travel limit of the contacts 116. In the illustrated embodiment, the over-travel blocks 240 are provided in the contact channels 180. For example, the over-travel blocks 240 may be provided in the relief slots 234 behind the mating ends 130. Optionally, the over-travel blocks 240 may be positioned being the interface bumps 230 to block deflection of the mating ends 130.

The over-travel blocks 240 may have any shape to interact with the contacts 116. In the illustrated embodiment, the over-travel blocks 240 are rectangular in shape with corners 242 of the over-travel blocks 240 engaging two different points of the interface bumps 230 to block deflection of the contacts 116 beyond the over-travel limit. However, the over-travel blocks 240 may have other shapes in alternative embodiments, such as a curved shape matching the curved shape of the interface bumps 230. In other alternative embodiment, the over-travel blocks 240 may be used to block other portions of the contacts 116, such as the distal end of the contact 116 or a portion of the contact 116 below the interface bumps 230.

Prior to loading the plug connector 105 into the card slot 112 the mating ends 130 of the contacts 116 may be spaced-apart from the over-travel blocks 240 such that a gap 244 exists between the contacts 116 and the over-travel blocks 240. When the plug connector 105 is loaded into the card slot 112, the mating ends 130 may be deflected outward into the first and second side walls 122, 124 until the contacts 116 engage the over-travel blocks 240. The over-travel blocks 240 limit deflection of the mating ends 130 of the contacts 116 and hold the contacts 116 against the plug connector 105.

Optionally, the shape of the interface bumps 230 may change when the plug connector 105 is loaded into the card slot 112. For example, as the interface bumps 230 are squeezed between the plug connector 105 and the over-travel blocks 240, the shape of the interface bumps 230 may change. For example, the interface bumps 230 may become flatter as the contact 116 is sandwiched between the over-travel block 240 and the plug connector 105.

In other various embodiments, the over-travel blocks 240 may hold the positions of the contacts 116 such that very little or no deflection of the mating ends 130 is allowed when the plug connector 105 is loaded into the card slot 112. For example, the over-travel blocks 240 in both the first and second side walls 122, 124 hold the contacts 116 such that the mating interfaces 232 between the contacts 116 on opposite side of the card slot 112 are spaced-apart by the width of the card edge 114 of the plug connector 105 such that the plug connector 105 is centered between the contacts 116 within the card slot 112. The alignment tabs 200 (shown in FIG. 9) serve to center the plug connector 105 within the card slot 112. In alternative embodiments, the housing 106 may be provided without the alignment tabs 200, rather relying upon the over-travel blocks 240 and the contacts 116 to center the plug connector 105 within the card slot 112. For example, FIG. 13 illustrates a portion of the housing 106 without the alignment tabs 200, instead showing the over-travel blocks 240 used in conjunction with the contacts 116 to center the plug connector 105 within the card slot 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector configured to mate with a plug connector, the receptacle connector comprising:

a housing having a mating end configured to mate with the plug connector and a mounting end opposite the mating end, the housing having first and second side walls extending between the mating end and the mounting end, the side walls having separating walls defining contact channels therebetween, the housing having over-travel blocks in the contact channels, the separating walls extending to interior surfaces, the housing having first and second end walls extending between the mating end and the mounting end, the housing having a card slot open at the mating end for receiving the plug connector, the card slot being defined by the interior surfaces of the separating walls on the first and second side walls with the interior surfaces facing each other across the card slot and configured to receive the plug connector between the interior surfaces of the separating walls on the first and second side walls, the housing including alignment tabs having alignment surfaces extending inward into the card slot beyond the interior surfaces of the separating walls for aligning the plug connector within the card slot, the alignment surfaces of the alignment tabs being located at a first depth from the mating end of the housing;

contacts held in the housing, the contacts being arranged in first and second contact arrays received in corresponding contact channels along the first and second side walls, respectively, the contacts having mating ends configured for electrical connection with the plug connector, the mating ends of the contacts being exposed in the card slot for mating electrical connection with the plug connector, the mating ends of the contacts being deflectable within the contact channels when mated with the plug connector, the contacts including interface bumps at the mating ends configured to interface with the plug connector, the interface bumps with aligned with the over-travel blocks such that the over-travel blocks block deflection of the mating ends beyond an over-travel limit of the contacts, the mating ends being arranged at a second depth from the mating end of the housing, the second depth being greater than the first depth such that the plug connector engages the alignment tabs prior to engaging the mating ends of the contacts during loading of the plug connector into the card slot, the contacts having terminating ends opposite the mating ends of the contacts; and a cable assembly mounted to the mounting end of the housing, the cable assembly having cables terminated to the terminating ends of corresponding contacts.

2. The receptacle connector of claim 1, wherein the alignment tabs have alignment surfaces facing the card slot, the alignment surfaces positioned closer to a center line of the card slot than to the interior surfaces of the separating walls on the first and second side walls.

3. The receptacle connector of claim 1, wherein the card slot has a first width between the interior surfaces of the first and second side walls, the card slot having a second width between the alignment tabs narrower than the first width.

4. The receptacle connector of claim 1, wherein the card slot has a center line centered between the interior surfaces of the first and second side walls, the alignment tabs having a tab center line centered between the alignment tabs opposing each other on opposite sides of the card slot, the tab center line being aligned with the center line of the card slot.

5. The receptacle connector of claim 1, wherein the alignment tabs are located remote from the separating walls and positioned outward of the contact arrays between the contacts and the first and second end walls.

6. The receptacle connector of claim 1, wherein the card slot includes four corners at the intersections of the first and second side walls with the first and second end walls, the alignment tabs being positioned in each of the four corners of the card slot.

7. The receptacle connector of claim 1, wherein the alignment tabs center the plug connector between the mating ends of the contacts in the first and second contact arrays.

8. The receptacle connector of claim 1, wherein the alignment tabs are integral with the first and second side walls being co-molded with the housing.

9. The receptacle connector of claim 1, wherein the contacts include signal contacts and ground contacts, the signal contacts being arranged in pairs with the ground contacts positioned between pairs of the signal contacts, wherein the separating walls between the pair of signal contacts have a first height and wherein the separating walls between the signal contacts and the ground contacts have a second height taller than the first height such that the separating walls between the signal contacts and the ground contacts isolate the signal contacts and the ground contacts, and wherein the separating walls between the pair of signal contacts allow edge coupling between the signal contacts of the pair of signal contacts.

10. The receptacle connector of claim 1, wherein the mating ends of the contacts are deflectable relative to the housing for mating with the plug connector, the housing including over-travel blocks blocking deflection of the mating ends of the contacts beyond an over-travel limit of the contacts.

11. The receptacle connector of claim 1, wherein the contact channels include relief slots behind the contacts into which the contacts are deflected when mated with the plug connector, the over-travel blocks being positioned in the relief slots behind the mating ends of the contacts.

12. A receptacle connector configured to mate with a plug connector, the receptacle connector comprising:

contacts arranged in a first contact array and a second contact array, the contacts in the first contact array including first signal contacts and first ground contacts, the first signal contacts being arranged in pairs, the first ground contacts being arranged between pairs of the first signal contacts, the contacts in the second contact array including second signal contacts and second ground contacts, the second signal contacts being arranged in pairs, the second ground contacts being arranged between pairs of the second signal contacts, the contacts having terminating ends opposite the mating ends, the contacts having mating ends configured for electrical connection with the plug connector;

a housing holding the contacts of the first contact array and holding the contacts of the second contact array, the housing having a mating end at a top of the housing configured to mate with the plug connector and a mounting end at a bottom of the housing, the housing having first and second side walls extending between the top and the bottom, the housing having first and second end walls extending between the top and the bottom;

the housing having first separating walls defining first contact channels along the first side wall, the contacts of the first contact array received in corresponding first contact channels along the first side wall, the mating ends of the contacts being deflectable within the corresponding first contact channels when mated with the plug connector, the first separating walls positioned between the first signal contacts and the first ground contacts, wherein the first separating walls between the pair of first signal contacts have a first height and wherein the first separating walls between the first signal contacts and the first ground contacts have a second height taller than the first height such that the first separating walls between the first signal contacts and the first ground contacts isolate the first signal contacts and the first ground contacts and the first separating walls between the pair of first signal contacts allowing edge coupling between the first signal contacts of the pair of first signal contacts;

the housing having second separating walls defining second contact channels along the second side wall, the contacts of the second contact array received in corresponding second contact channels along the second side wall, the mating ends of the contacts being deflectable within the corresponding second contact channels when mated with the plug connector, the second separating walls positioned between the second signal contacts and the second ground contacts, wherein the second separating walls between the pair of second signal contacts have a first height and wherein the second separating walls between the second signal contacts and the second ground contacts have a second height taller than the second height such that the second separating walls between the second signal contacts and the second ground contacts isolate the second signal contacts and the second ground contacts and the second separating walls between the pair of second signal contacts allowing edge coupling between the second signal contacts of the pair of second signal contacts;

the housing having a card slot open at the mating end for receiving the plug connector, the mating ends of the contacts being exposed in the card slot for mating electrical connection with the plug connector.

13. The receptacle connector of claim 12, further comprising a cable assembly mounted to the mounting end of the housing, the cable assembly having cables terminated to the terminating ends of corresponding contacts.

14. The receptacle connector of claim 12, wherein the housing includes alignment tabs extending inward into the card slot from interior surfaces of the first and second side walls for aligning the plug connector within the card slot, the alignment tabs having alignment surfaces facing the card slot, the alignment surfaces positioned interior of the interior surfaces of the first and second side walls.

15. The receptacle connector of claim 14, wherein the alignment tabs have alignment surfaces facing the card slot, the alignment surfaces positioned closer to a center line of the card slot than to the interior surfaces of the separating walls on the first and second side walls.

16. The receptacle connector of claim 14, wherein the card slot has a first width between the interior surfaces of the first and second side walls, the card slot having a second width between the alignment tabs narrower than the first width.

17. The receptacle connector of claim 12, wherein the mating ends of the contacts are deflectable relative to the housing for mating with the plug connector, the housing including over-travel blocks blocking deflection of the mating ends of the contacts beyond an over-travel limit of the contacts.

18. The receptacle connector of claim 17, wherein the contact channels include relief slots behind the contacts into which the contacts are deflected when mated with the plug connector, the over-travel blocks being positioned in the relief slots behind the mating ends of the contacts.

* * * * *